US007744395B1

(12) United States Patent
Cantolino

(10) Patent No.: US 7,744,395 B1
(45) Date of Patent: Jun. 29, 2010

(54) QUICK-DISCONNECT WATERPROOF CONNECTOR

(76) Inventor: Christopher Ralph Cantolino, 3711 Cortez Rd. West, Suite 300, Bradenton, FL (US) 34210

( * ) Notice: Subject to any disclaimer, the term of this patent is extended or adjusted under 35 U.S.C. 154(b) by 0 days.

(21) Appl. No.: 12/575,441

(22) Filed: Oct. 7, 2009

Related U.S. Application Data

(63) Continuation-in-part of application No. 12/565,765, filed on Sep. 24, 2009.

(51) Int. Cl.
*H01R 13/52* (2006.01)

(52) U.S. Cl. ..... 439/279

(58) Field of Classification Search ..... 439/278–279, 439/274–276, 449, 587–589
See application file for complete search history.

(56) References Cited

U.S. PATENT DOCUMENTS 2,127,544 A * 8/1938 Von Holtz ..... 439/279

* cited by examiner

*Primary Examiner*—Javaid Nasri
(74) *Attorney, Agent, or Firm*—Dorothy S. Morse

(57) ABSTRACT

A quick-disconnect waterproof connector for secure connection of electrical wires to one another in series, in applications where water or other fluids may be present. The most preferred connector has two connecting members each with opposing ends, a pin adjacent to a socket in side-to-side array at a first of said opposing ends, over-molding around the pin and socket, a plurality of external ribs laterally extending across the over-molding on opposing sides thereof, the over-molding around the base of the pin having a tapered boss, the over-molding extension around the distal end of the socket configured for snugly receiving the tapered boss of its paired member to create a waterproof connection, two sheathed insulated wires each connected to one of the contacts, and the over-molding also having on its second end a strain-relief extension positioned around the sheathed insulated wires as they enter the over-molding.

14 Claims, 2 Drawing Sheets

QUICK-DISCONNECT WATERPROOF CONNECTOR

CROSS-REFERENCES TO RELATED APPLICATIONS

This application is a continuation-in-part of a previously filed and currently pending U.S. utility patent application to the same inventor, which was given the Ser. No. 12/565,765, was filed on Sep. 24, 2009, and has overlapping subject matter to that in the new patent application now being filed. The previously filed and currently pending U.S. utility patent application from which domestic priority for the instant patent application herein is desired also has a title of "Water Detection Assembly for Primary Drain Lines" and an. Since the quick-disconnect connector disclosed herein is one of components in the water detection assembly invention disclosed in the previously filed and currently pending U.S. Patent application identified hereinabove, and the applicant has filed this new patent application in an attempt to receive patent protection solely for the quick-disconnect connector component thereof, domestic benefit based upon this previously filed U.S. patent application identified above is now requested for this new patent application being filed.

BACKGROUND

1. Field of the Invention

This invention relates to the field of pin-and-socket connectors used for mating electrical wires, specifically to a quick-disconnect waterproof connector that is employed to provide a secure and waterproof connection of electrical wires to one another in series, in applications where water or other fluids may be present. The most preferred connector of the present invention has two elongated connective members of identical construction, an advantage in lowering production cost. Each elongated connective member has a first end with an electrically-conductive pin positioned in side-to-side array with a socket comprising electrically-conductive material. Over-molding is formed around each socket and the base of the pin paired with it, with a plurality of external ribs laterally extending across the exterior surface of the over-molding on opposed sides thereof. The over-molding around the base of the pin also comprising a tapered boss and the over-molding around the distal end of the socket has an opening with a straight wall bore, and is otherwise configured and dimensioned for snugly receiving the tapered boss adjacent to the paired pin to create a waterproof connection and seal there around. Each connecting member further has a second end that receives two sheathed insulated wires one of which is in electrical communication with the pin and the other of which is in electrical communication with the socket, with the over-molding on the second end comprising a protective strain-relief extension positioned around the sheathed wires as they enter into the over-molding to provide a waterproof seal around them. During use, the two identical elongated connective members would be oriented relative to one another so that each pin aligns with an opposed socket, with the gripping ribs on the exterior surface of the over-molding then being used to gently, but with sufficient force, insert the tapered boss around the base of each pin into the straight wall bore through the over-molding around the distal end of the opposed socket, with the tapered boss eventually pushing a portion of the straight wall bore outward to enhance the formation of a waterproof connection and seal. Although the most preferred embodiment of the present invention has one pin positioned in side-by-side array with one socket in each elongated connective member, it is contemplated for the scope of the present invention to also include elongated connective members providing three or more electrical connections, such as but not limited to two pins and one socket in one connecting member that would require two complementary sockets and one pin in the connecting member paired with it. Applications of the present invention may include, but are not limited to, use in connecting probes and switches employed in water detection applications.

2. Description of the Related Art

In applications where water or other fluids may be present, use of waterproof connectors to electrically link the wires associated with probes and switches to one another is critical to ensure reliable electrical communication between them, and that prompt action will be taken when fluids accumulate beyond a threshold level considered safe. This is vitally important for equipment used for water detection purposes, as a breakdown in communication between probes and switches only allows more fluid to accumulate, escalating the risk for damage to surroundings. A capability to withstand temperature extremes is also important to probes and switches used for fluid-overflow monitoring functions related to air conditioning applications, one of the contemplated applications of the present invention herein, as some air conditioning system components producing condensate are placed in a hot attic or in a non-climate-controlled garage. Furthermore, while weatherproof pin-and-socket connectors are known for use in providing brake and turn lights for trailers towed behind a truck, which are able to withstand moisture and temperature extremes, none are known to have all of the features and advantages of the present invention, particularly the at least one pin and the at least one socket in side-by-side array in each elongated connective member (with such an array providing balance when a connecting force is applied to paired connective members to join or separate them), in combination with the tapered boss at the base of each pin and a straight wall bore in the over-molding extension around the distal end of each socket (wherein the tapered boss pushes the straight wall bore in an outwardly direction to create an enhanced waterproof connection), and ribs on the exterior surface of the over-molding that with the other previously-mentioned features provide for a proper installer-applied connection force being used that allows opposed connective members to be pressed completely together and the tapered boss at the base of each pin to have a better lead-in chamfer into the straight wall bore of the over-molding extension around the distal end of the opposed socket. In addition, the tapered boss around the base of each pin causing the straight wall bore of the over-molding extension around the distal end of each paired socket to be pushed outward, in addition to providing an enhanced waterproof connection and seal, allows for low insertion forces and larger manufacturing tolerances. The larger manufacturing tolerances provide more favorable manufacturing cost, and low insertion forces are needed so that installers are able to press paired elongated connective members completely together while still providing for a waterproof connection and seal for enhanced reliability of successful electrical communication, which is needed for the long-term use (years at a time) in fluid-overflow monitoring functions related to air conditioning applications.

BRIEF SUMMARY OF THE INVENTION

The primary object of this invention is to provide a quick-disconnect connector for secure and waterproof connection of electrical wires to one another in series, in applications where water or other fluids may be present. Another object of this invention is to provide a quick-disconnect waterproof connector having rugged and durable construction for long-term use. It is also an object of this invention to provide a quick-disconnect waterproof connector the two parts of which are easily joined together, yet do not easily come apart unless separation is intended. It is a further object of this invention to provide a quick-disconnect waterproof connector that provides strain-relief accommodation for wiring connected to it, which also helps to achieve a waterproof seal for the electrically-conductive components within its over-molding. It is also an object of this invention to provide a quick-disconnect waterproof connector having an easily gripped exterior surface. Another object of this invention is to provide a quick-disconnect waterproof connector with low manufacturing cost.

The present invention, when properly made and used, will provide a quick-disconnect waterproof connector for secure connection of electrical wires to one another in series, in applications where water or other fluids may be present, such as but not limited to fluid-overflow monitoring applications related to air conditioning systems. The most preferred connector in the present invention has two identical elongated connective members each having a pin positioned adjacent to a socket in side-to-side array on one of its opposing ends, over-molding around the socket and much of the pin, with a plurality of external ribs laterally extending across the over-molding on opposed sides thereof, and further with the over-molding around the base of the pin having a tapered boss, the over-molding around the straight-walled open end of the socket configured for snugly receiving the tapered boss of the other elongated connective member to create a waterproof connection around the opposed pins and sockets that become joined, and the over-molding also having on the second one of its opposing ends a protective strain-relief extension positioned around the sheathed insulated wires as they enter into the over-molding. The strain-relief extension, in combination with a two-part wire terminal depending from the proximal end of each socket and pin, allows the electrical wiring of the present invention to remain securely connected to the socket and pin even when as much as eight pounds of force are applied to the wiring in an attempt to interrupt electrical communication between the wiring and the pins and sockets. The tapered boss pushes the straight wall bore adjacent to a paired socket in an outwardly direction to create an enhanced waterproof connection around the pins and sockets. In addition, the tapered boss also has a better lead-in chamfer into the straight wall bore of the over-molding extension around the distal end of the opposed socket so that low insertion installer-applied connection forces will allow the opposed connective members to become completely pressed together to make the proper and needed watertight connection and seal. The use of a tapered boss in combination a straight wall bore to create a watertight seal in this connection device, also permits larger manufacturing tolerances, providing decreased manufacturing costs The description herein provides preferred embodiments of the present invention but should not be construed as limiting its scope. For example, variations in the length, width, and thickness dimensions of the over-molding, the number of laterally-extending ribs used on the exterior surface of the over-molding, the length, width, and height dimensions of each rib, the materials from which the over-molding is made as long as it is waterproof and has tolerance to temperature extremes, the number of electrical wires used, and the height dimension of the tapering boss, other than those shown and described herein, may be incorporated into the present invention. Thus, the scope of the present invention should be determined by the appended claims and their legal equivalents, rather than being limited to the examples given.

LIST OF COMPONENT NUMBERS

Figure 1:
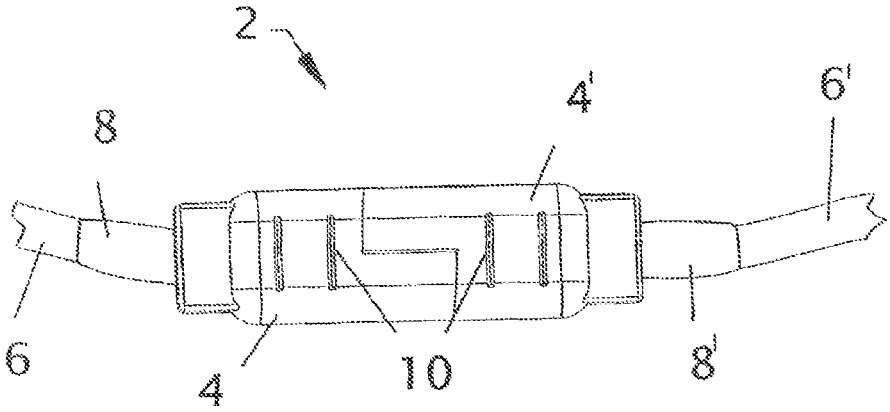
FIG. 1 is a top view of the most preferred embodiment of the present invention connector having two identical and opposed elongated connective members joined completely together to provide a waterproof connection and seal for the pins and sockets hidden within its over-molding.

2—a quick-disconnect waterproof connector with two parts that can be manually and separated from one another (used for secure connection of electrical wires to one another in series)

4 and 4'—over-molding made from a non-conductive and waterproof material or materials

6 and 6'—sheathed wiring comprising at least two insulated electrical wires

8 and 8'—strain-relief extension depending outwardly from the over-molding 4 and 4' (made from non-conductive and waterproof material, and can be the same material or materials used in over-molding 4 and 4')

10—laterally-extending ribs on opposed sides of the exterior surface of over-molding 4 and 4'

12 and 12'—electrically-conductive pin (typically joined via crimping of 30 or 30' to a non-insulated end 24 of an electrical wire 22 positioned within the over-molding 4 or 4'

14 and 14'—extension of over-molding 4 or 4' around a socket 18 or 18' that is configured for receiving tapered boss 20 or 20', which together create a waterproof connection/seal around electrically-conductive sockets 18 and 18' and their paired electrically-conductive pins 12 or 12'

16 and 16'—distal end of electrically-conductive pin 12 or 12' comprising a narrowing tip and a non-uniform diameter dimension adjacent to the narrowing tip

18 and 18'—electrically-conductive socket

20 and 20'—tapered boss of over-molding 4 or 4' around the base of a pin 12 or 12'

22—individual insulated electrical wires bundled together to form sheathed wiring 6 or 6'

24—portion of electrical wires 22 having insulation removed for electrical connection to a socket 18 or 18', or to a pin 12 or 12'

26 and 26'—smaller wire terminal component at distal end of 30 or 30'

28 and 28'—larger wire terminal component

30 and 30'—wire terminal (comprises 26/26' and 28/28')

DETAILED DESCRIPTION OF THE INVENTION

The present invention provides a quick-disconnect waterproof connector 2 that can be employed for secure connection of electrical wires 22 to one another in series, in applications where water or other fluids may be present. The most preferred connector 2 has two connective members each with over-molding (given the numbers of 4 and 4' in the accompanying illustrations). Each connective member also has a pin 12 or 12' positioned adjacent to a socket 18 or 18' in side-to-side array, over-molding 4 and 4' positioned around both the pins and sockets (12/12' and 18/18') with a plurality of external ribs 10 laterally extending across its exterior surface on both of its opposing sides. In addition, each connective member also has over-molding 4 or 4' around the base of its pin 12 or 12' that comprises a tapered boss 20 or 20', with the over-molding 4 or 4' around the open end of the socket 18 or 18' configured as an extension 14 or 14' that snugly receives the tapered boss 20 or 20' of its paired connective member to create a waterproof connection, and the over-molding 4 or 4' of each connective member also having a strain relief extension 8 or 8' opposed from the pins and sockets (12/12' and 18/18') that is positioned around the sheathed wiring 6 or 6' as it enters into the over-molding 4 or 4'. In many applications, the length and width dimensions of the present invention quick-disconnect waterproof connector 2 will be less than two inches and one-inch, respectively, although not limited thereto. Furthermore, one should recognize that the illustrations herein generally represent the preferred structure, proportion, and placement of present invention components. Thus, the accompanying illustrations should not be relied upon for determining the relative size or configuration of such components, or any size and/or configuration limitations, and the scope of the present invention should be determined by the claims appended hereto and their legal equivalents, rather than being limited to the examples given immediately below.

Figure 2:
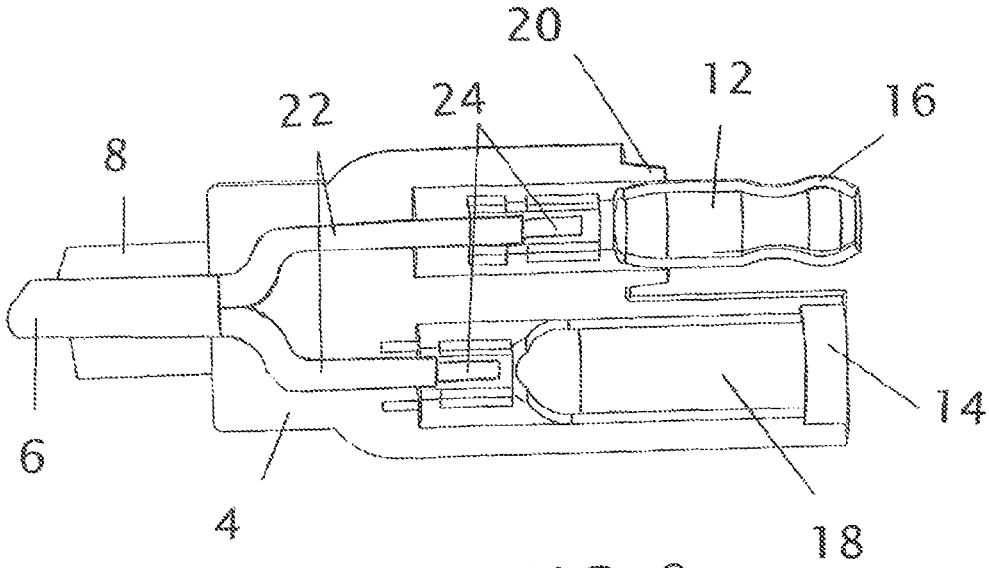
FIG. 2 is a sectional view of one of the elongated connective members in the most preferred embodiment of the present invention.
Figure 3:
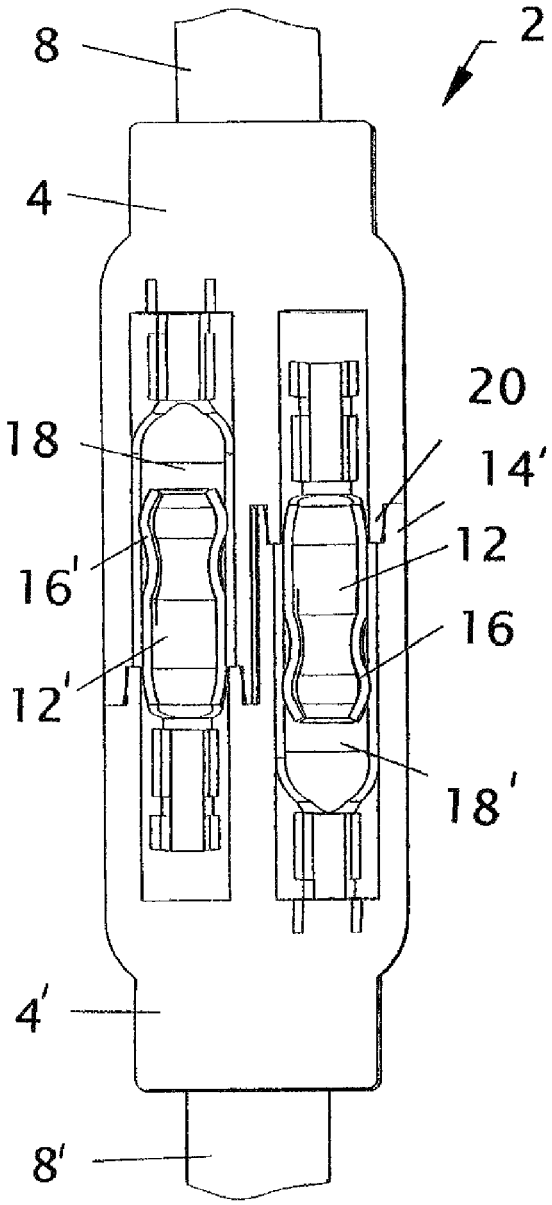
FIG. 3 is a sectional view of the side-to-side positioning of the two sets of paired pins and sockets in the most preferred embodiment of the present invention when two opposed elongated connective members are joined completely together to provide a waterproof connection and seal.
Figure 4:
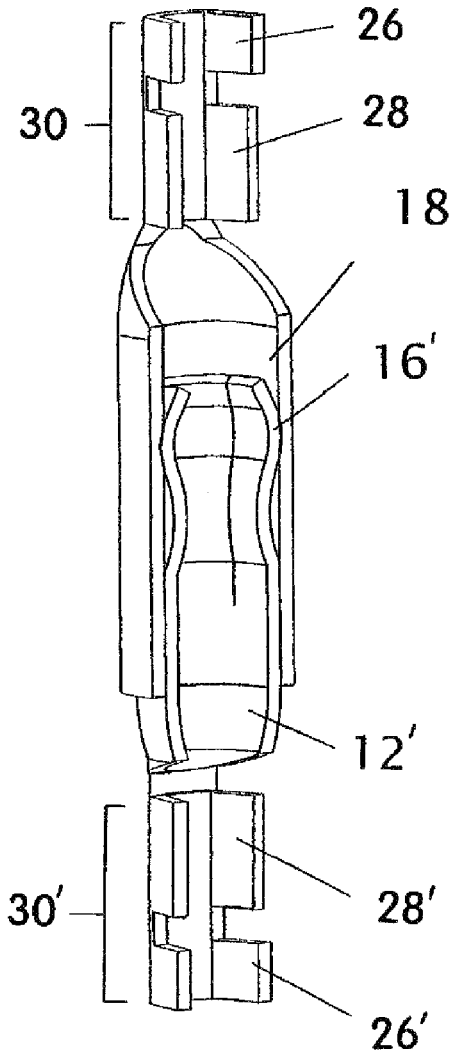
FIG. 4 is a sectional view of a pin and socket in the most preferred embodiment of the present invention, which also shows the two-part wire terminal configuration used to maintain a secure electrical communication between the electrical wiring and each socket or pin.

FIGS. 1-4 show the most preferred embodiment of the present invention quick-disconnect waterproof connector 2. FIG. 1 is a top view of the most preferred embodiment of the present invention connector 2 having two identical and opposed elongated connective members with over-molding 4 and 4' that are joined completely together to provide a waterproof connection and seal therebetween. FIG. 2 is a sectional view of one of the elongated connective members in connector 2, with its over-molding marked by the number 4. FIG. 3 is a sectional view of the side-to-side positioning of the two sets of paired pins and sockets (12 and 18, and 12' and 18') in connector 2 when the two opposed elongated connective members with over-molding 4 and 4' are joined completely together to provide a waterproof connection and seal therebetween. FIG. 4 is a sectional view of the distal end of an electrically-conductive pin 18 joined with an opposed electrically-conductive socket 12' that are both usable as a part of in connector 2, which also shows the two-part wire terminal 30 configuration used to maintain a secure electrical communication between the electrical wiring 6 or 6' and each socket 18 or 18' (or pin 12 or 12').

In FIG. 1 a first connective member having over-molding 4 is shown on the left side of the illustration, with two widely spaced-apart ribs 10 on the exterior surface of over-molding 4, a strain-relief extension 8 depending from the free end of over-molding 4 that is positioned around sheathed electrical wiring 6 as it enters over-molding 4. On the right side of FIG. 1, one sees a second connective member made from over-molding marked with the number 4'. As will also be seen in FIG. 3, the second connective member with over-molding 4' is identical in structure and dimension to the first-mentioned connective member (on the left side of FIG. 1) having over-molding 4, with which it is paired. The second connective member having over-molding 4' also has two widely spaced-apart ribs 10 on the exterior surface of over-molding 4', a strain-relief extension 8' depending from the free end of over-molding 4' that is positioned around sheathed electrical wiring 6' as it enters over-molding 4'. When first connective member having over-molding 4 and second connective member having over-molding 4' are securely joined together, they provide a waterproof connection and seal that preserves electrical communication between sheathed electrical wiring 6 and sheathed electrical wiring 6'. Although not visible in FIG. 1, it is contemplated for the hidden sides of over-molding 4 and over-molding 4' to also have ribs 10, which may have the same size, placement, number, and configuration as that shown on the visible sides of over-molding 4 and over-molding 4', or not. When the present invention has two elongated connective members of identical construction, which is preferred but not critical, lower production cost becomes an advantage/benefit. The materials used for over-molding 4 and strain relief extension 8, as well as for over-molding 4' and strain relief extension 8', may be the same or different.

FIG. 2 shows first connective member in the most preferred embodiment of the present invention quick-disconnect waterproof connector having over-molding 4. Since it is contemplated for the interior structure of the second connective member having over-molding 4' to be identical, a duplicate illustration for the second connective member having over-molding 4' is not provided. FIG. 2 shows sheathed electrical wiring 6 entering over-molding 4 via a strain-relief extension 8 that creates a waterproof seal between sheathed electrical wiring 6 and over-molding 4. FIG. 2 also shows the two individual insulated wires 22 within sheathed electrical wiring 6 being separated from one another, with one wire 22 being connected to socket 18 and the other wire 22 being connected to pin 12. As can be seen in FIG. 2, before the respective connections of the two wires 22 to socket 18 and pin 12, a portion of the insulation around the end of ach wire 22 is removed to provide a non-insulated portion 24 that is in direct electrical communication with the wire terminal 30 (see FIG. 4) depending from socket 18 or pin 12. FIG. 2 also shows the over-molding around the base of pin 12 comprising a tapered boss 20 and the over-molding around the distal end of socket 18 having an opening with a straight wall bore 14 that is configured and dimensioned for snugly receiving tapered boss 20 adjacent to the paired pin 12 to create a waterproof connection and seal around pin 12. FIG. 2 further shows the preferred configuration of narrowing tip and non-uniform diameter dimension adjacent thereto that helps to provide reliable electrical communication between pin 12 and socket 18. Size is not a limiting factor for the present invention quick-disconnect waterproof connector, nor is the number of pins 12 and sockets 18 used, as long as each pin 12 becomes mated within a different opposed socket 18, when the two connecting members of the present invention are joined together to provide reliable electrical communication between electrical wiring segments connected in series.

FIG. 3 shows a sectional view of the most preferred embodiment of the present invention quick-disconnect waterproof connector 2 that reveal the general positioning of pins 12 and 12' and sockets 18 and 18' inside it. At one end thereof is over-molding 4 and its associated strain-relief extension 8, and in an opposed position thereto is over-molding 4' and its associated strain-relief extension 8'. The interfaces between over-molding 4 and over-molding 4' (such as that marked by the numbers 20 and 14') is found near the numbers 12 and 12', and one appears in close contact with the other, thereby indicative of a watertight/waterproof seal. The number 20 indicates the tapered boss around the base of pin 12, and the number 14' indicates the straight-walled extension around socket 18'. As shown in two places in FIG. 3, tapered boss 20 pushes straight-walled extension 14' in an outwardly direction to create an enhanced waterproof connection around the pin 12 and socket 18' (or pin 12' and socket 18). In addition, the tapered boss 20 also has a better lead-in chamfer into the straight wall bore of the over-molding extension 14' so that low insertion installer-applied connection forces will allow the opposed connective members to become completely pressed together to make the proper and needed watertight connection and seal therebetween. The use of tapered boss 20 and extension 14' also permits larger manufacturing tolerances, providing decreased manufacturing cost. For clarity of illustration purposes only, FIG. 3 shows no sheathed electrical wiring 6 or 6', and also has no individual insulated wires 22 connected to sockets 18 or 18', or to pins 12 or 12'. In contrast, FIG. 4 shows the pin 12' on the left side of FIG. 3 connected to socket 18, independent of over-molding 4 and 4', wiring 6 or 6', and strain-relief extensions 8 and 8'. The enlarged view of FIG. 4 shows more clarity in the structural detail of wire terminals 30 and 30', which comprise smaller wire terminals 26 and 26' in close association with larger wire terminals 28 and 28'. Smaller wire terminals 26 and 26' are crimped around individual wires 22 still having insulation around them, while larger wire terminals 28 and 28' are each crimped around a non-insulated end 24 of a wire 22. The two-part wire terminals 30 and 30' provide a more secure connection between individual wires 22 and the respective pin 12 or 12' (or socket 18 or 18') with which it is associated. The strain-relief extensions 8 and 8' shown in FIG. 3, in combination with two-part wire terminals 30 and 30', allows the electrical wiring 6 and 6' of the present invention to remain securely connected to the socket (18 or 18') or pin (12 or 12') even when as much as eight pounds of force are applied to the electrical wiring 6 or 6' in an attempt to dislodge it from strain-relief extension 8 or 8'. FIGS. 3 and 4 further show the preferred configuration of narrowing tip and non-uniform diameter dimension adjacent thereto that forms the distal end 16 or 16' of electrically-conductive pin 12 or 12', and assists in providing secure and reliable electrical communication between pin 12 or 12' and socket 18 or 18'. Size is not a limiting factor for the present invention quick-disconnect waterproof connector 2, nor is the number of pins 12 or other, and sockets 18 or other used, as long as each pin 12 (or other) becomes mated within a different opposed socket 18 (or other), when the two connecting members of the present invention are joined together to provide reliable electrical communication between electrical wiring 6, 6' or other segments connected in series. Furthermore, pins 12 or other, sockets 18 or other, and their wire terminals 30 or other, can comprise silver-plated copper, although not limited thereto.

What is claimed is:

1. A quick-disconnect waterproof connector for secure connection of electrical wires to one another in series, said connector comprising:

two lengths of sheathed electrical wiring each comprising at least two insulated wires, each of said lengths of electrical wiring having an unsheathed end wherein said at least two insulated wires are separated from one another, and further wherein each said at least two insulated wires has an insulation-free tip;

two connecting members each formed from over-molding placed over and around said unsheathed end of one of said lengths of electrical wiring, said over-molding comprising a strain-relief extension making contact with a portion of said sheathed electrical wiring where said at least two insulated wires are not separated from one another and configured to provide a waterproof seal therebetween, and each said connecting member having an engagement end located remotely from said strain-relief extension;

at least one electrically-conductive pin and at least one electrically-conductive socket in side-to-side array with one another at said engagement end of said connecting member, said at least one electrically-conductive socket positioned within said over-molding and said at least one electrically-conductive pin positioned within said over-molding so that part thereof remains extending beyond said over-molding, each said at least one electrically-conductive pin and each said at least one electrically-conductive socket placed in electrical communication with a different one of said insulation-free tips of said at least two insulated wires positioned within said over-molding of each said connecting member, with the number and positioning of said at least one pin present in one said connecting member allowing for engagement therewith by one of said sockets in the other one of said connecting members in opposed relation thereto, and the number and positioning of said at least one socket present in the same one of said connecting members allowing for engagement therewith by one of said pins in the other one of said connecting members pin in opposed relation thereto;

a portion of said over-molding on each said connecting member that is located immediately around each said at least one pin having a tapered boss; and a portion of said over-molding on each said connecting member located adjacent to said at least one socket being in the form of a straight-walled extension configured for snugly receiving one said tapered boss so as to provide a waterproof seal therebetween, wherein when said engagement ends of both said connecting members are joined together, said electrically-conductive pins and said electrically-conductive sockets in opposed relation are placed in watertight electrical communication with one another, thus providing secure and reliable electrical communication between said two lengths of sheathed electrical wiring.

2. The connector of claim 1 wherein said two connecting members each have a configuration identical to the other.

3. The connector of claim 1 wherein said over-molding in each said connecting member has an exterior surface with a plurality of ribs laterally extending across said exterior surface.

4. The connector of claim 3 wherein said exterior surface of said over-molding has opposed sides, said ribs are present on both of said opposed sides, and said ribs are further configured to allow said connecting members to become completely pressed together to make a watertight connection and seal therebetween with low insertion installer-applied connection forces.

5. The connector of claim 3 wherein said ribs are widely spaced apart from one another on said exterior surface.

6. The connector of claim 1 wherein each said at least one electrically-conductive pin and each said at least one electrically-conductive socket in each said connecting member has a wire terminal that is configured for crimping around one said insulated wire and said insulation-free tip adjacent thereto.

7. The connector of claim 6 wherein said wire terminal further comprises a smaller wire terminal component configured for being crimped around one said insulated wire and a larger wire terminal component having a longer length dimension than said smaller wire terminal component, and is configured for being crimped around one said insulation-free tip.

8. The connector of claim 1 each said pin further comprises a non-uniform diameter dimension.

9. The connector of claim 8 wherein said narrowing tips of said pins and said straight-walled extensions associated with said sockets in each said connecting member have identical positioning in distance relative to said strain-relief extension associated with the same one of said connecting members.

10. The connector of claim 1 wherein each said pin has a narrowing tip extending beyond said over-molding.

11. The connector of claim 10 each said pin further comprises a non-uniform diameter dimension adjacent to said narrowing tip.

12. The connector of claim 1 wherein each said pin is substantially inserted into a paired one of said sockets during connector use.

13. The connector of claim 1 wherein said pins and said sockets are centered within said over-molding.

14. The connector of claim 1 wherein a major portion of each said pin extends from said over-molding.

* * * * *